US012366380B2

(12) United States Patent
Cunningham et al.

(10) Patent No.: US 12,366,380 B2
(45) Date of Patent: Jul. 22, 2025

(54) MODULATION SYSTEMS AND METHODS FOR INSTANTANEOUS HOT WATER APPLICATIONS

(71) Applicant: The Marley Company LLC, Charlotte, NC (US)

(72) Inventors: Owen A. Cunningham, Michigan City, IN (US); Ryan Hardesty, Valparaiso, IN (US); Daniel G. Karch, LaPorte, IN (US)

(73) Assignee: THE MARLEY COMPANY LLC, Charlotte, NC (US)

( * ) Notice: Subject to any disclaimer, the term of this patent is extended or adjusted under 35 U.S.C. 154(b) by 41 days.

(21) Appl. No.: 17/327,368

(22) Filed: May 21, 2021

(65) Prior Publication Data

US 2022/0373226 A1 Nov. 24, 2022

(51) Int. Cl.

| | |
|---|---|
| ***F24H 9/20*** | (2022.01) |
| ***F24D 19/10*** | (2006.01) |
| ***F24H 1/10*** | (2022.01) |
| ***F24H 9/00*** | (2022.01) |

(52) U.S. Cl.

CPC ..... *F24H 9/2007* (2013.01); *F24D 19/1066* (2013.01); *F24D 19/1081* (2013.01); *F24H 1/10* (2013.01); *F24H 9/0005* (2013.01); *F24D 2220/042* (2013.01); *F24D 2220/044* (2013.01); *F24D 2220/06* (2013.01)

(58) Field of Classification Search

USPC ..... 237/8 A

See application file for complete search history.

(56) References Cited

U.S. PATENT DOCUMENTS

| | | | | |
|---|---|---|---|---|
| 5,233,970 | A | 8/1993 | Harris | |
| 9,228,759 | B2 | 1/2016 | Ando | |
| 9,599,365 | B2 | 3/2017 | Hardesty et al. | |
| 2010/0326646 | A1 | 12/2010 | Kim et al. | |
| 2013/0144451 | A1* | 6/2013 | Kumar | G05B 13/02 700/291 |
| 2014/0229022 | A1* | 8/2014 | Deivasigamani | F24D 17/0036 700/282 |
| 2015/0059732 | A1 | 3/2015 | Qia et al. | |
| 2015/0276265 | A1* | 10/2015 | Davari | F24H 15/156 700/300 |
| 2018/0163994 | A1 | 6/2018 | Suzuki | |

(Continued)

*Primary Examiner* — Steven B McAllister
*Assistant Examiner* — John E Bargero
(74) *Attorney, Agent, or Firm* — Husch Blackwell LLP

(57) ABSTRACT

Systems and methods are directed to water healer systems, including combi boilers and instantaneous water heaters, for initiating pre-heat and energy savings operations. Embodiments of the present invention can include at least one heat exchanger, a plurality of temperature sensors sensing water temperature at one or more locations within the water heater system, and a control system in communication with the first and second heat exchangers. In embodiments, the control system can be configured to at least: determine an expected demand for hot water, determine a target modulation rate based on the plurality of temperature sensors, and the expected demand, monitor the plurality of temperature sensors and a flow rate, and update the modulation rate based on at least one of a detected change in flow rate and a detected change in at least one of the plurality of temperature sensors.

20 Claims, 9 Drawing Sheets

(56) References Cited

U.S. PATENT DOCUMENTS

| | | | | |
|---|---|---|---|---|
| 2018/0180299 | A1* | 6/2018 | Hallit | F24D 19/1012 |
| 2020/0292179 | A1 | 9/2020 | Miyazaki et al. | |
| 2021/0123610 | A1* | 4/2021 | Gagne | F24D 3/08 |
| 2022/0034543 | A1 | 2/2022 | Alanqar et al. | |
| 2022/0349622 | A1* | 11/2022 | Gagne | F24H 9/2035 |
| 2022/0373194 | A1 | 11/2022 | Cunningham et al. | |
| 2022/0373195 | A1 | 11/2022 | Cunningham et al. | |
| 2022/0373227 | A1 | 11/2022 | Cunningham et al. | |
| 2024/0102696 | A1 | 3/2024 | Konowalczyk | |

* cited by examiner

MODULATION SYSTEMS AND METHODS FOR INSTANTANEOUS HOT WATER APPLICATIONS

FIELD OF THE INVENTION

This invention relates generally to a water heating system. More particularly, the present invention relates, for example, to systems and methods for controlling and monitoring operations of water heating systems.

BACKGROUND OF THE INVENTION

Boilers are used to generate heat for various applications such as domestic hot water and building heat. For installations with large variations in the heat demand, multiple boilers are often used that can turn on and off as needed. While this may provide some benefits such as allowing simultaneous operation for different uses (e.g., heating and domestic hot water "DHW"), multiple boilers require additional space to accommodate the multiple boiler tanks or cylinders. Combi-boilers are single, compact boilers that provide both heating and hot water on demand. This makes combi-boilers and ideal alternative to conventional boilers, especially when space is limited. However, there are many challenges with respect to efficient hot water delivery and operations of such boilers.

Consumers are increasingly replacing storage-based water heaters with instantaneous water heaters, both with standalone water heaters and with combi boilers. While instantaneous water heaters can provide longer sustained draws, one drawback is that they do not have the built-in storage capacity to satisfy low- or short-draw demands, which leads to potentially excessive water use when waiting for hot water to be delivered to the fixture in use.

There are several methods that can be used to help alleviate this, such as building in additional buffer capacity within the unit on the domestic water side, using recirculation loops to circulate hot water throughout the system, or by adding a function commonly referred to as a pre-heat operation. Pre-heat functions charge the boiler, usually based on temperature decay or time delay, to a higher storage temperature titan usually used for the DHW delivery temperature. Due to this, however, the frequency of boiler operation due to pre-heat can be excessive without adding in additional limits on the pre-heat operation. As such, improved pre-heating mechanisms are needed.

Moreover, instantaneous water heater production, both in direct-fired water heaters and combi boiler appliances, requires a quick response to changing water temperatures and flows, to provide a steady delivery temperature to tire user. Through varying flow demands, both due to mixing variation and cycling demands, this can be difficult to maintain through traditional modulation algorithms, due to expected step changes in the system, such as users or appliances starting and stopping hot water flow.

Similar to a temperature-sensing device on a storage water heater appliance, instantaneous hot water appliances can further use a DHW temperature measurement to determine when to activate a heating demand (in the case of a storage water heater) and/or control the temperature being delivered (esp. in the case of an instantaneous water heater). If this temperature measuring device (commonly a thermistor in the case of instantaneous water heaters) foils, the appliance is unable measure or control the temperature being delivered, and will commonly enter a lockout state that disables the appliance from delivering any hot water until repaired.

Instantaneous hot water appliances rely on low water mass to quickly and steadily provide higher flow demands than what would be expected from a larger storage water heater appliance, often at the cost of having less storage capacity for initial surges. There are several methods to combat improving the initial response time, including installing buffer storage tanks or recirculation loops on the DHW Outlet flow path, but if the appliance does not have a quick-enough startup time, these surge-capacity methods can still be depleted before hot water can be delivered directly from the appliance.

Counter to this, appliances relying on gas combustion for the primary heat source need to undergo several steps on the startup sequence to ensure a safe operation of the appliance, including a purge sequence intended to vacate any residual gas or flue products lingering in the system. Depending on the appliance size, the amount of time taken to do this can be somewhat noticeable when waiting for hot water at the use-point.

Accordingly, there are significant needs to improve the function and operation of hot water appliances, especially instantaneous hot water appliances and combi boilers, to optimize hot water delivery and efficiently manage system operations.

SUMMARY OF THE INVENTION

The foregoing needs are met, to a great extent, by the present invention, wherein aspects of boiler monitoring and control systems and methods, as discussed herein. The present invention applies to instantaneous domestic hot water production and generation. In embodiments, the present invention applies to combi boiler applications.

Systems and methods are directed to water heater systems, including combi boilers and instantaneous water heaters, for initiating pre-heat and energy savings operations. Embodiments of the present invention can include at least one heat exchanger configured to heat water; and a control system in communication with the at least one heat exchanger. The control system can be configured to at least detect a flow of hot water from the at least one heat exchanger; monitor the flow of hot water to determine a pattern of usage; receive an indication to end the flow of hot water from the at least one heat exchanger; initiate a recovery demand determination based on the pattern of usage, and initiate a pre-heat operation based on the recovery demand determination.

Additional systems and methods are directed to water heater systems, including combi boilers and instantaneous water heaters, for initiating, back up operations, e.g., for continuous flow and hot water delivery, in response to errors or interruptions to normal operations. Embodiments of the present invention can include a plurality of heat exchangers, including a domestic hot water outlet, temperature sensors sensing water temperature at one or more locations within the water heater system, a control system in communication with the first and second heat exchangers. The control system can be configured to at least, monitor the water temperature measured by the first temperature sensor, identify an abnormality in monitoring the water temperature, initiate an alternative operation to sense water temperature via an alternate pathway and heat water to a set point value during the abnormality, and deliver water heated to the set point value during the abnormality.

Systems and methods are further directed to water beater systems, including combi boilers and instantaneous water heaters, for initiating off-cycle purge operations, e.g., for energy reductions and efficiency means. Embodiments of the present invention can include at least one heat exchanger configured to heat water, at least one temperature sensor measuring water temperature at one or more locations within the heater system, and a control system in communication with the at least one heat exchanger. The control system can be configured to at least: heat water via the at least one beat exchanger in response to a request for hot water, monitor water temperature at an outlet of the at least one heat exchanger, initiate a burner sequence when the outlet temperature is greater than a delivery target temperature, and initiate a purge sequence when the when the outlet temperature is greater than a threshold temperature.

Further embodiments include systems and methods directed to water heater systems, including combi boilers and instantaneous water heaters, for initiating pre-heat and energy savings operations. Embodiments of the present invention can include at least one heat exchanger, a plurality of temperature sensor s sensing water temperature at one or more locations within the water heater system, and a control system in communication with the first and second heat exchangers. In embodiments, the control system can be configured to at least, determine an expected demand for hot water, determine a target modulation rate based on the plurality of temperature sensors, and the expected flow demand, monitor the plurality of temperature sensors and a flow rate, and update the modulation rate based on at least one of a detected change in flow rate and a detected change in at least one of the plurality of temperature sensors.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Various embodiments of the present invention provide for an improved boiler system and related control and monitoring methods.

Figure 1:
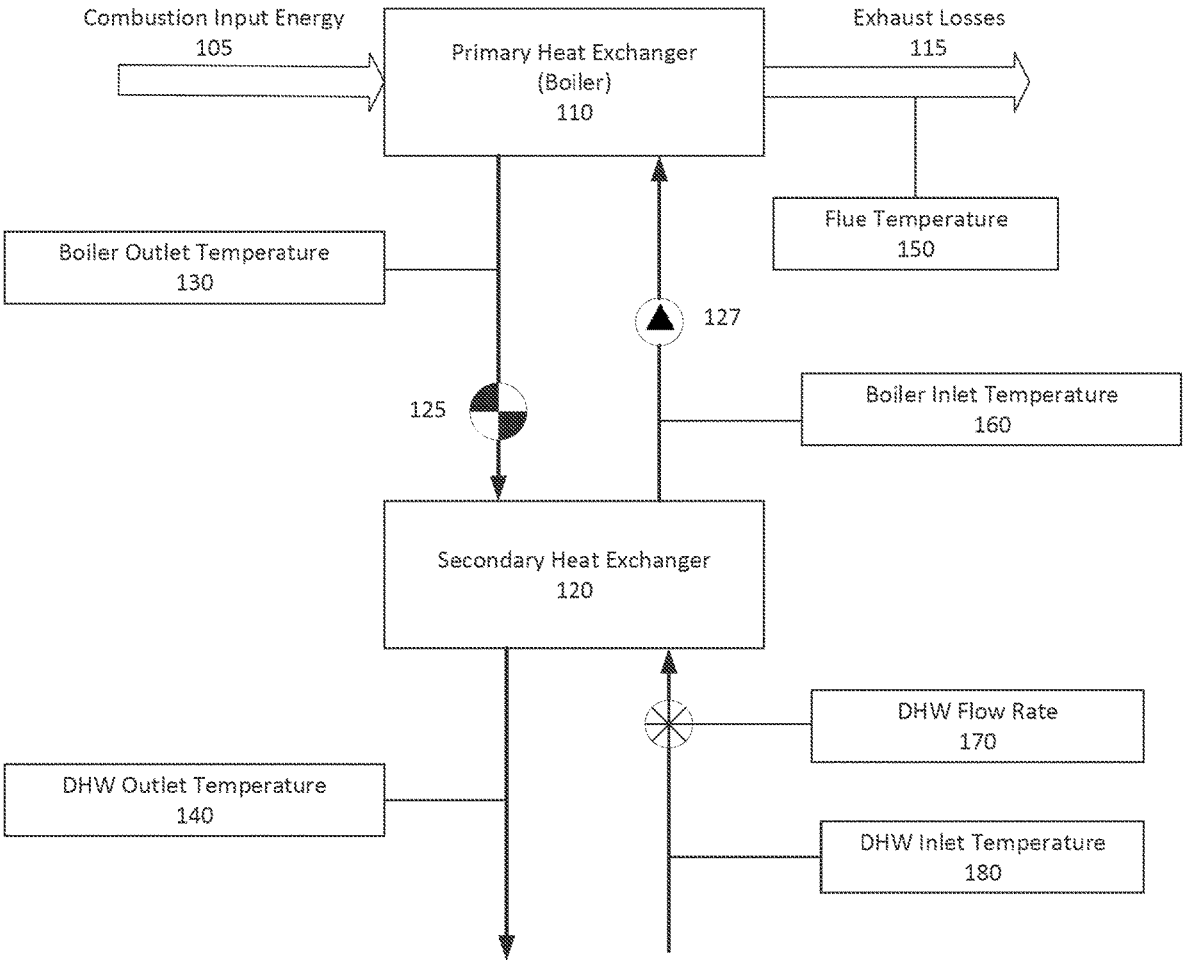
FIG. 1 illustrates a boiler system in accordance with embodiments.

Turning now to the drawings, FIG. 1 illustrates a boiler system, usable with multiple embodiments of the present invention. It will be appreciated that various embodiments of the present invention are applicable with combi boiler systems, instantaneous water heaters, direct-fired water heaters, and similar hydronic systems. FIG. 1 illustrates one such boiler system comprising a primary hear exchanger 110 and a second heat exchanger 120. Embodiments in accordance with the present invention can use only a single heat exchanger 110, e.g., a boiler, and still achieve the functions and capabilities described herein. In water heaters, for example, there may be only one heat exchanger. In such embodiments, DHW water outlet and DHW water inlet temperatures can be located on a same flow path as the primary heat exchanger 110. As such, it will be appreciated that FIG. 1 can be utilized with embodiments of the present invention, with the secondary heat exchanger 120 being optional in various systems and appliances.

With reference to FIG. 1, a primary heat exchanger receives combustion input energy 105 usable to heat a volume of water interacting with, e.g., flowing through, the heat exchanger. Exhaust losses 115 can comprise gas and other waste materials leftover after heating operations at the primary heat exchanger 110. In various embodiments, heat exchangers can be heated via electricity and/or other non-combustion sources. In various embodiments, heat exchangers can transfer heat from flue gas to boiler water in appliances, such as a combi-boilers, or from flue gas to domestic water in a tank less water heater and/or an instantaneous water heater. Various types and configuration of heat exchanges are applicable to embodiments of the present invention.

Water heated at tire primary heat exchanger 110 can be delivered to a secondary beat exchanger 120. In various embodiments, the second heat exchanger 120 heats water in response to a domestic hot water demand. Each of the heat exchangers comprise inlets and outlets to deliver water to one or more locations, and to receive water from one or more locations. For example, the primary heat exchanger 110 can comprise a water inlet to receive water from a water tank, and a water inlet to receive water from the secondary heat exchanger 120, as illustrated herein. Likewise, the second heat exchanger can contain a water inlet to receive water from the primary heat exchanger 110, a water outlet delivering water to the primary heat exchanger, a pump 127, a water inlet, e.g., a domestic hot water outlet, delivering water from the secondary heat exchanger 120, and a water outlet, e.g., a domestic hot water inlet, to receive water at the secondary heat exchanger. A diverting valve 125 can optionally be positioned between the primary heat exchanger 110 and the secondary heat exchanger 120. In embodiments, a control system can manage the valve to direct flow into any one of the secondary heat exchanger 120, and a hydronic heating system if applicable. The valve 125 could further connect supply and/or return of flow between heat exchangers.

A plurality of temperature sensors can be incorporated at various points throughout the heater system, as illustrated herein, and consistent with various embodiments, as depicted and discussed herein. A boiler outlet temperature sensor can measure a boiler outlet temperature 130 of water delivered from the primary heat exchanger 110. A sensor can likewise measure a DHW outlet temperature 140 for water delivered from the secondary heat exchanger.

Both DHW inlet, temperature 180 and a DHW flow rate 170 can be measured for DHW received at the secondary heat exchanger 120. Such temperatures and flow rates measurements are useful for various operations and embodiments discussed herein. A boiler inlet temperature 160 is measured from flow between the secondary heat exchanger 120 and the primary heat exchanger 110. A flue temperature 150 is measurable from exhaust losses 115 following operation of the primary heat exchanger 110.

Figure 2:
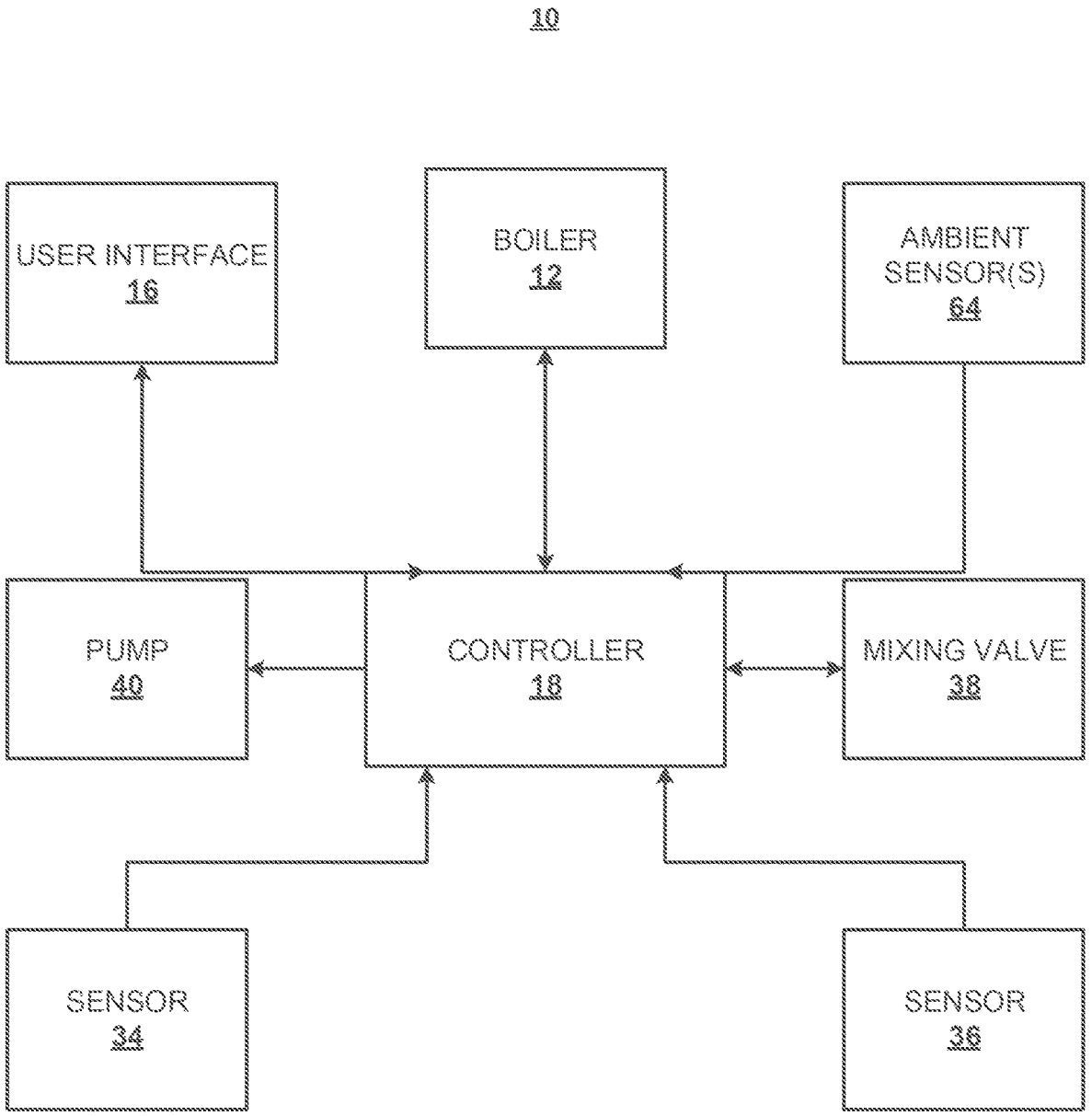
FIG. 2 illustrates a system architecture for hot water heater systems in accordance with embodiments.

FIG. 2 illustrates a block diagram of a system architecture for the hot water heater appliance 10 in accordance with embodiments discussed herein. As shown in FIG. 2, the controller 18 may be configured for two way communication between the boiler 12, user interface 16, sensors 34 and 36, and circulator pump 40. In addition, the controller 18 is optionally configured for two-way communication between a mixing valve assembly 38 and/or an ambient sensor 64. In various embodiments, mixing valve 38 can be mechanical device and can have one or more physical control components, e.g., a dial, to adjust the temperature of the mixed fluid. In an example, the set temperature causes blending of the proper proportions of Hot and Cold water to get the desired mixed temperature.

On a combi boiler embodiment, there embodiments can comprise a diverting valve, and/or a 3-way valve that the controller can manage. Such control can allow water flow to the secondary heat exchanger for a DHW demand or through to the hydronic heating system for a heating demand.

In operation, the controller is configured to receive user input from the user interface 16 and, based on this user input, control the various other components of the hot water heater appliance 10 to provide DHW. The controller 18 may determine one or more aspects of the temperature within the hot water storage tank 32 via the sensed conditions at the sensors 34 and 36. For example, if the temperature at the sensor 34 is dropping relatively quickly, the controller 18 may determine DHW is being drawn out quickly (and DCW is being, drawn in quickly to replace it). In another example, if the temperature at both the sensors 34 and 36 are falling very slowly, then the controller 18 may determine that little or no DHW is being drawn out. As such, the controller 18 may be able to accurately determine draw without the added complication of a flow meter.

Control of the boiler 12 may include sensing temperatures at one or more locations, sensing gas or fuel flow, ignition, ventilation control, and the like. These and other aspects of controlling a conventional non-condensing or condensing boiler are generally known to those skilled in the art. If the optional ambient sensor 64 is included, the controller 18 is configured to sense the ambient temperature and the ambient temperature may be factored into the control of the hot water beater appliance 10. For example, temperature loss in tire hot water storage tank 32 is a function of the difference in temperatures between the hot water storage tank 32 and the ambient temperature. To reduce thermal loss at time of relatively low ambient temperature, the controller 18 may maintain the temperature in the hot water storage tank 32 at a relatively lower temperature. In another example, at times of relatively low ambient temperature, DHW water usage may rise or fall depending upon the habits of the users of the DHW. The controller 18 may be configured to facture in ambient temperature in order to learn DHW usage trends. These DHW usage trends may be factored into the control of the hot water heater appliance 10 to supply sufficient DHW efficiently.

Figure 3:
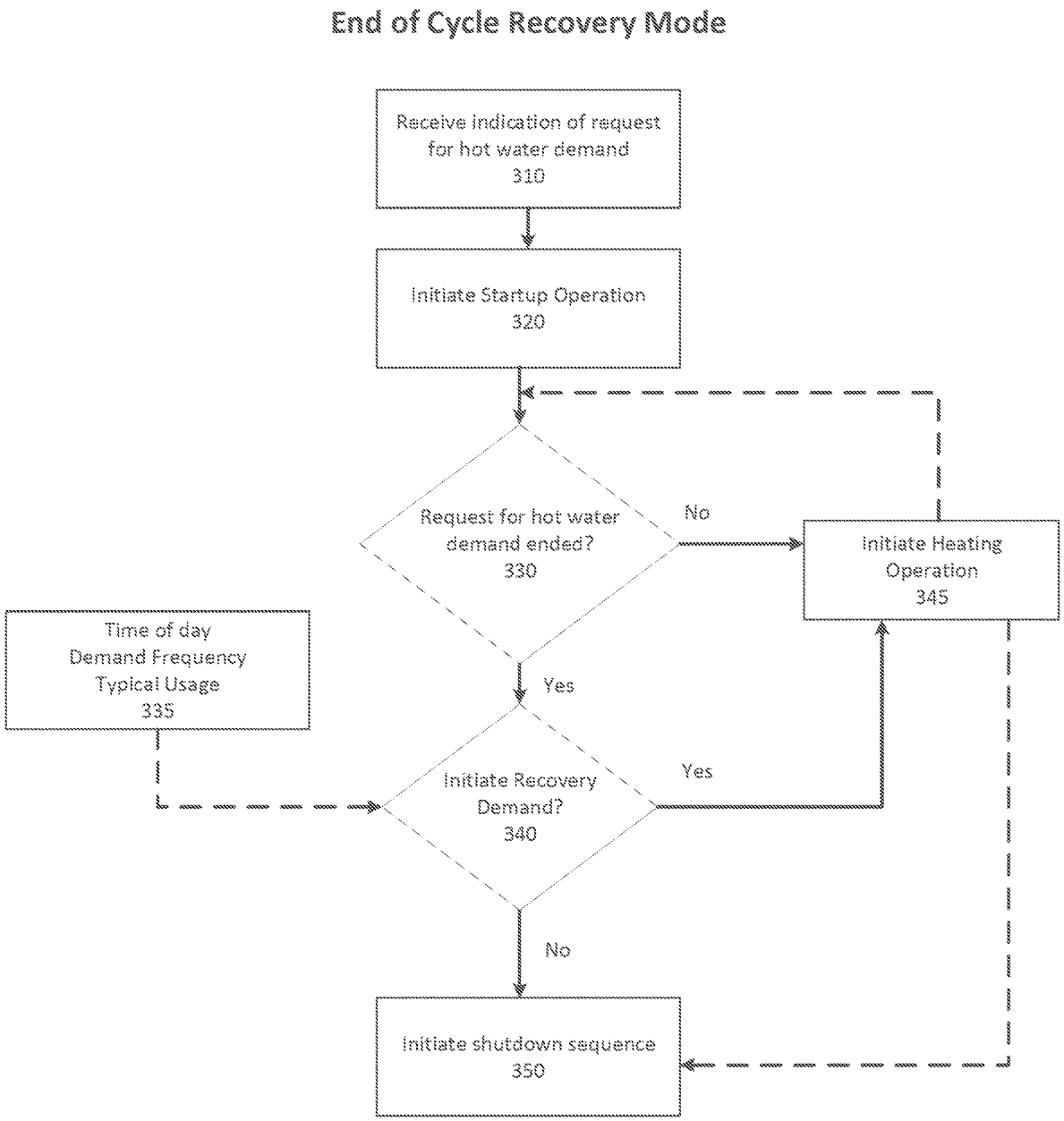
FIG. 3 illustrates an end-of-cycle recovery mode operation, in accordance with embodiments.

FIG. 3 relates to systems and methods for reactively storing energy for use in instantaneous hot water applications and providing an end-of-cycle recovery mode. As discussed herein, conventional water heaters, especially instantaneous water heaters and those with pre-heat applications are prone to excessively draw water due to capacity limitations. Many pre-heat applications, such as common combi boiler pre-heat applications cycle the boiler based on timing or temperature, trying to always maintain a heat exchanger temperature regardless of usage. However, this can contribute to excessive, unnecessary energy usage.

To address various challenges discussed herein, embodiments of the present invention provide improved systems and methods for pre-heat operations, through an "end-of-cycle" recovery mode. In various embodiments, the recovery mode can act as a one-time application of the pre-heat mode, and adjust, as needed, based on demands. Accordingly, the present invention can be ore reactive to the flow occurring in real-time. For example, in embodiments, if the control detects flow (e.g., via flow, temperature, pressure, etc.) a "pre-heat" function for the next DHW event can be initiated by continuing a burner operation to "pre heat" the heat exchanger for the next DHW event. This is particularly beneficial when the DHW events are very short in duration, and when the boiler does not have enough time to start the burner and raise the temperature of the water. A traditional combi boiler or water heater, for example, would turn its burner off when DHW water flow stopped.

In many applications, DHW usage is more frequent between certain time windows (e.g., periods in the morning and in the evening). Accordingly, with the present recovery mode operations, the boiler can utilize this information and be charged, for example, through short draws and supply heat in times of higher demand, but not continue to operate during periods of sustained downtime. As such, the recovery mode uniquely incorporates such use and timing to optimize heating operations.

The recovery mode can further be a control function tied to heater operation, e.g., combi boiler operation, to significantly improve DHW performance based on repeated demands.

FIG. 3 illustrates a flow chart summarizing an example end-of-cycle recovery mode in accordance with embodiments. A boiler system can receive an indication of a request for a hot water demand 310. In various embodiments, the boiler can implement normal startup operations 320. In other embodiments, one or more separate optional initiation routines and/or energy saving operations to optimize initiation of the hot water flow, e.g., boiler. In an example the boiler system can rely on its internal water volume to create a thermal charge of energy, which can be used on the start of a DHW demand to heat the water without having to start a burner demand. The energy saving operations can vary based on one or more of a type of heater, available resources (e.g., hot water, information regarding typical usage, type of request etc.)

Accordingly, the boiler system initiates hot water flow, which can be deliverable to one or more destinations depending on a where the request(s) were initiated. The hot water flow can continue until the boiler system receives an indication of a request to end the water flow, thus indicating that there is no longer a hot water demand. In various embodiments, the DHW flow can be boiler water flowing through the one or more heat exchangers based on pump control.

The boiler system can implement a recovery demand decision 340 to determine whether to start a recovery demand pre-heat operation 345. In embodiments, at the end of flow demand, regardless of whether the boiler has begun a burner-on operation, the boiler determines if it should progress to a recovery demand. In additional embodiments, the end-of-cycle recovery mode only initiates its operation at the end of a detected DHW flow demand. As noted in FIG. 6, if the request for hot water demand has ended, the system moves to a recovery demand decision 340, as discussed below. If the hot water demand has not yet ended, the system can optionally initiate a heating operation 345, as needed.

The recovery demand decision 340 can utilize additional information regarding the boiler system's operation, to determine whether to initiate the pre-heat operation 345. In various embodiments the decision can be based on one or more factors 335, such as time of day, time of greatest usage, demand frequency, anticipated usage, typical usage, past demand, and the like. Such factors can be based on information automatically obtained, manually entered, and/or set within the control system of the boiler system. Certain factors can be given more weight in the recovery demand decision determination 340. In various embodiments, the recovery demand decision can utilize one or more factors or data sets available to the control system of the boiler, and can dynamically adjust based on prior history, actual use, anticipated use, and other available information. In embodiments, the appliance can operate normally in the startup sequence through burner operation, up until the point the DHW flow is no longer recognized on the appliance.

In either case, i.e., whether the pre-heat operation is initiated, the indication to stop the hot water flow results in initiating a shutdown sequence 350. In the case where the recovery demand determination determines to cease water flow without the recovery demand pre-heat operation 345, the flow of water ends, and the system resumes, as normal until a next request for hot water.

When the recovery determination results in initiating the pre-heat operation 345, the boiler system can utilize the hot water in preparation for a subsequent request and initiation of hot water flow 320. The pre-heat operation can vary depending on one or more settings, including but not limited to expected usage, a time of day, a volume amount, or other settings depending on the demands, including consumer demands, for the boiler system.

In a non-limiting example, during high use periods, such as a morning time, e.g., 6-8 am, initiation of the recovery demand pre-heat operation occurs during this window, thus ensuring that hot water is readily available during the period of heavy use. In a low-demand time window, e.g., early afternoon, or other time period of historic low use, the recovery demand decision 340 can decide to initiate a shutdown sequence 350 without initiating the pre-heat operation. This allows the boiler to only recover energy during potential high-use periods, and can be activated through pre-draw recirculation demands, thus minimizing boiler cycling and fuel use. Accordingly, the end-of-cycle recovery mode can be a one-time application of the pre-heat mode and utilize assumptions—manually or automatically determined—regarding DHW usage.

In another non-limiting example, a request for DHW flow can be initiated upon operation of an appliance, such as a faucet. The boiler can detect that flow and initiate a startup sequence 315, which can include positioning a diverter valve, as discussed herein, to force boiler water through a secondary heat exchanger, thus starting the pump, blower, and eventually burner. When the DHW demand stopped, e.g., by a user, a determination can be made as to whether the boiler should continue to run the burner to beat the heat exchangers and water, in order to prepare for a next DHW demand.

Figure 4:
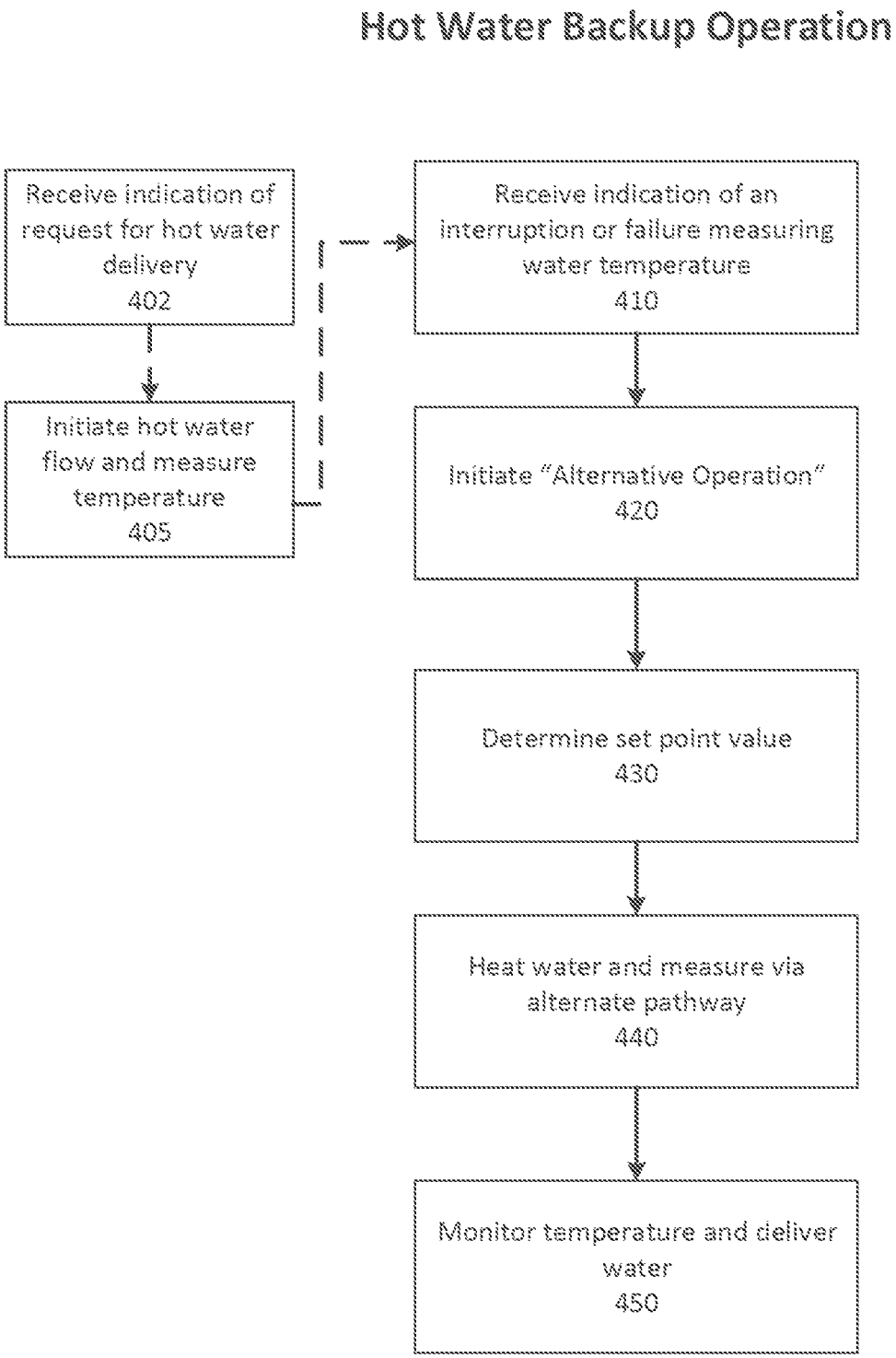
FIG. 4 illustrates a hot water outlet backup operation, in accordance with embodiments.
Figure 5:
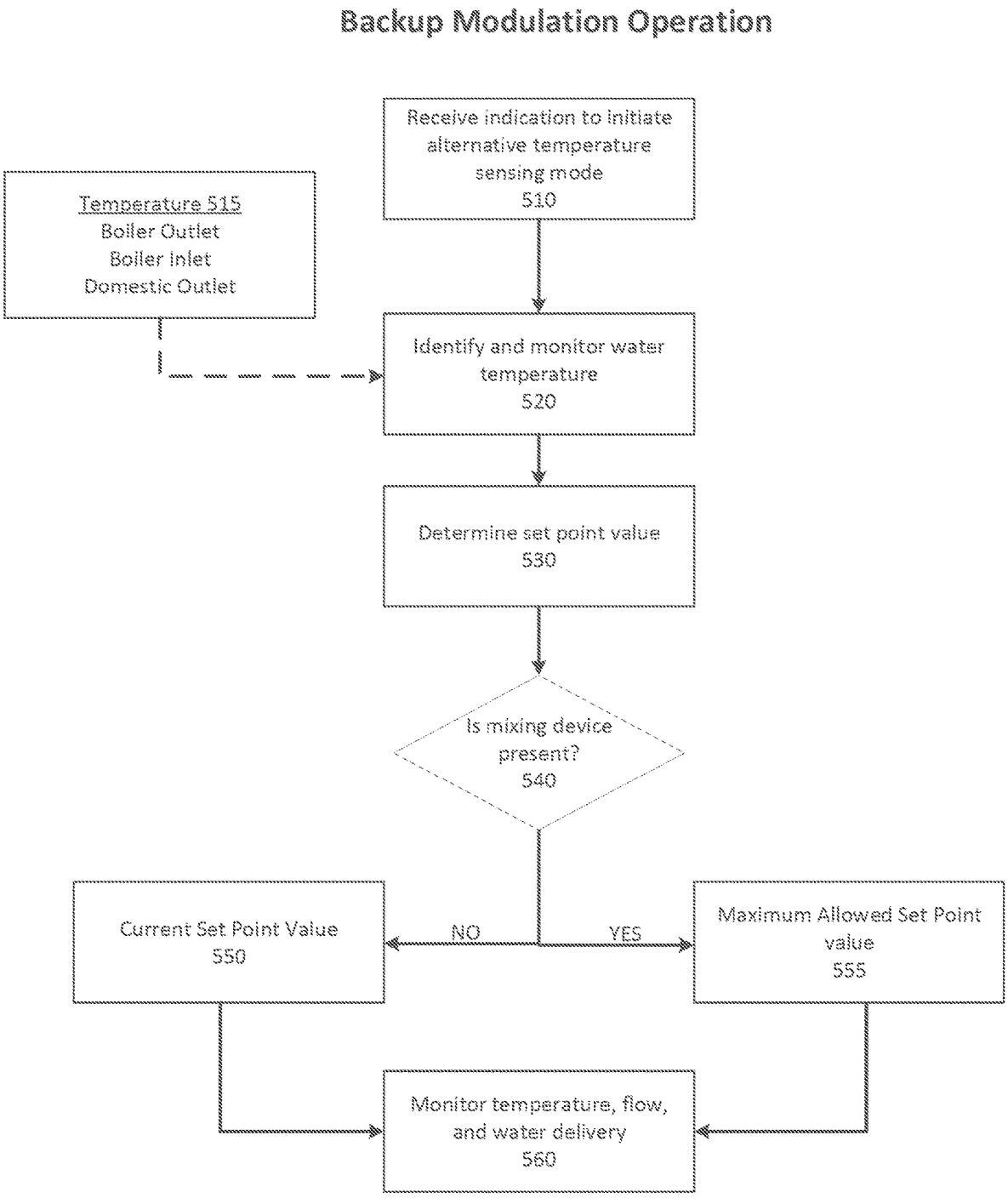
FIG. 5 illustrates a backup modulation operation, in accordance with embodiments.

FIGS. 4-5 relate to systems and methods for maintaining instantaneous domestic hot water production in sub-optimal appliance condition. The embodiments provide various backup operations to sustain hot water production and delivery in cases where there are interruptions to normal operations.

Many heater systems, especially boiler systems and combi appliances, typically rely on a temperature sensor—often a single temperature sensor—when executing hot water delivery options. The sensor typically measures the hot water delivery temperature to determine accuracy of delivery. The hot water temperature is often taken at, in, or around an outlet of hot water delivery. Accordingly, any failure or inaccuracy of temperature sensor, will result in the heater system and/or appliance being unable to accurately deliver hot water, if at all.

FIG. 4 illustrates a hot water outlet backup operation, which can address system interruptions or failures like temperature sensor issues. The backup operations discussed herein are control functions, which can be directly tied to a boiler operation, e.g., a combi boiler operation, to continue to allow the boiler system to deliver hot water demands, e.g., DHW, during a loss, failure, and/or interruption of the temperature measurement. In these embodiments, the boiler will continue to deliver a varying hot water temperature. Depending on the additional applied methodology, the boiler can deliver an outlet water temperature at an elevated range, while relying on an external mixing device to provide the desired delivery temperature at expected flow demands.

As illustrated in FIG. 4, the boiler system can receive an indication of an interruption or failure when measuring a water temperature 410. The temperature measurement is the standard method by which the boiler system determines water temperature during normal operation. In embodiments, the interruption can be an indication of a temperature sensor failure, a lack of temperature reading, e.g., for a certain period of time, or other indication and/or notification that there is otherwise an issue with at least one device related to the normal temperature sensing operations.

In embodiments, the temperature sensor may be routinely monitored in one or more ways, to evaluate its function constantly or periodically. In examples, the interruption or failure of the water temperature sensing 410 can occur before, during, or after the boiler system receives a request for hot water delivery 402. Likewise, the interruption or failure of the water temperature sensing 410 can occur before, during, or after the boiler system begins initiating hot water flow to one or more appliances 405.

Normal temperature sensing can occur, most often, at an outlet, such as a DHW outlet. However, it will be appreciated that the normal mode temperature sensing can occur at one or more locations of the boiler system, including but not limited to a DHW outlet, a boiler inlet, and a boiler outlet, as discussed herein.

Following an indication of a failure, interruption, or other issue with measuring water temperature 410, such as a sensor failure, the control system can initiate the boiler system to operate in an alternate mode, e.g., a "alternative operation" 420. In this alternative operation setting, the boiler system can continue to respond to hot water demands, e.g., DHW demands, using the boiler water temperature as the modulating target. In other words, water stored in the boiler tank will be used as a baseline for adjusting heating mechanisms and operations.

A set point value 430, indicative of a target value to heat the water, is determined using the boiler tank's water temperature. In embodiments, the set point can be a minimum temperature value necessary for certain operations. In an example, the set point can be a temperature that would keep a space, e.g., a home, office, garage, location, etc., at a minimum temperature. The set point value can be manually or automatically set. In embodiments, the set point value is measured by a backup temperature sensor, which may be located within the tank, or other location where it can provide feedback to the control system and therefore allow the boiler system to monitor the water temperature in this alternate manner.

As discussed herein, the set point value provides the basis for water temperature to be measured via an alternate pathway 440, i.e., in the alternative mode. The backup temperature sensor provides the information necessary to instruct the boiler system to heat the water until the primary temperature sensor is repaired, replaced, or otherwise functional. Accordingly, the water temperature can continue to be monitored, and heated water can be delivered 450 despite failure in the primary temperature sensor.

FIG. 5 expands upon the alternative operation and provides an operational overview for a backup modulation operation in accordance with embodiments. At 510, the system receives an indication to initiate an alternative temperature sensing mode. This indication can be the result of a temperature sensor failure and/or interruption as discussed herein.

Temperature can be measured in one or more locations on boiler and heating systems and discussed herein. In the case of a combi boiler appliance, for example, there can be three temperatures 515 being measured: The Domestic Outlet water temperature, the Boiler Outlet, and the Boiler Inlet water temperatures. In various embodiments, a combi boiler is also able to detect the DHW water flow, which can also be used to generate a heating demand.

Most typically, the domestic outlet flow is where temperature is sensed during normal operation. However, it will be appreciated that the temperature sensing is not limited to that location and can be from any of a plurality of temperature sensors placed at various locations in the heating system.

Errors, interruptions, and failure of a normal water temperature sensing system can be addressed by initiating the alternative temperature sensor, and continuing monitoring water temperature. In embodiments, the alternative temperature sensing mode causes the water to be measured and monitored 520. In embodiments, the water temperature can be a tank water temperature and/or a boiler/heat exchanger's water outlet temperature. This measured water will typically be lower in temperature than the hot water demanded. In embodiments, modulation can be based on this temperature, since it is the driving force of resultant DHW temperature, which is not operating normally, e.g., sensor failure, electrical short, etc. In embodiments, if a target boiler/heat exchanger outlet temperature is chosen, there is little to no potential for DHW overheating.

The heater system then determines a set point value 530 to target to heat the water, i.e., in the water tank. In many cases, the set point will also be lower than the initially demanded hot water temperature. This is due to the water tank being more likely to contain a larger volume of water, which would take more energy and time to heat, compared to the likely smaller volume requested from the hot water demand. By heating the tank water, a minimum temperature can be maintained despite a temperature sensor failure. The present systems and methods further provide benefits such as an uninhibited performance during temperature sensor failure, i.e., a single sensor failure, and an ability to continue to satisfy hot water delivery even when the boiler is not operating in an optimal condition.

In various embodiments, the set point value can be adjusted based on whether a mixing device is present 540. When paired with a mixing valve set to a lower mixed temperature than the delivery target, the boiler system can still satisfy low to medium demands while waiting on repair.

In a case where there is no mixing device present, the system can set the set point value to the currently saved set point value 550. This will ensure the safest operation without relying on an external mixing device to temper higher DHW Outlet temperatures at lower flow demands. In embodiments, the set point value refers to the Boiler Outlet temperature.

In a case where there is a mixing device present, the boiler can set the set point to a maximum-allowed set point value, e.g., a higher temperature target for a boiler outlet. In this case the set point value can refer to the Domestic Outlet Setpoint value. Confirmation of an external mixing device installation can be manually and/or by the control system of the boiler system. Setting the set point to the maximum allowed value will allow higher performance at low and medium flow demands, since the elevated Domestic Outlet temperature being delivered will be tempered via the mixing device.

In both cases, the boiler will continue to monitor temperature, flow, and water delivery 560. In embodiments, the boiler system will follow its normal feedback modulation tied to the Boiler Outlet sensor. The temperature monitoring and management can occur through these alternate means until the normal temperature sensor operations are restored, and/or until the control system receives an indication to return to the typical temperature sensing mode.

Accordingly, in embodiments, when the system receives a request for a flow demand, and the main temperature sensor is not operating correctly, the boiler can begin a normal startup procedure. After startup, once the boiler is free to modulate, it will use the Boiler Outlet as a target sensor, with the two potential options for the target setpoint.

DHW Demand Off-Cycle Operation

Instantaneous hot water delivery performance is largely driven by the quickness of the delivery time for the hot water to reach its target. Systems and appliances often rely on low water mass to quickly and steadily provide higher flow demands than what would be expected from a larger storage water heater appliance and utilize gas combustion for the primary heat source to quickly heat water on demand. During, such gas combustion operations, when a heating system, e.g., a combi boiler or an instantaneous hot water heater appliance, receives a hot water demand 610, the instantaneous hot water heater operates in accordance with numerous safety codes, such as the requirement of the boiler to purge the combustion system of any lingering fuel products.

To improve the startup time over traditional methods, embodiments of the present invention preemptively start the purge sequence while a hot water outlet temperature is still above the delivery target temperature. For example, the purge timing can nut while the system is still delivering heat from a hot heat exchanger. Since the boiler can initially satisfy demand without needing the burner on, the blower will continue to run in anticipation of starting the burner operation. Then, once the boiler reaches the delivery target temperature, the burner can be immediately started to place additional thermal energy into the DHW demand.

Figure 6:
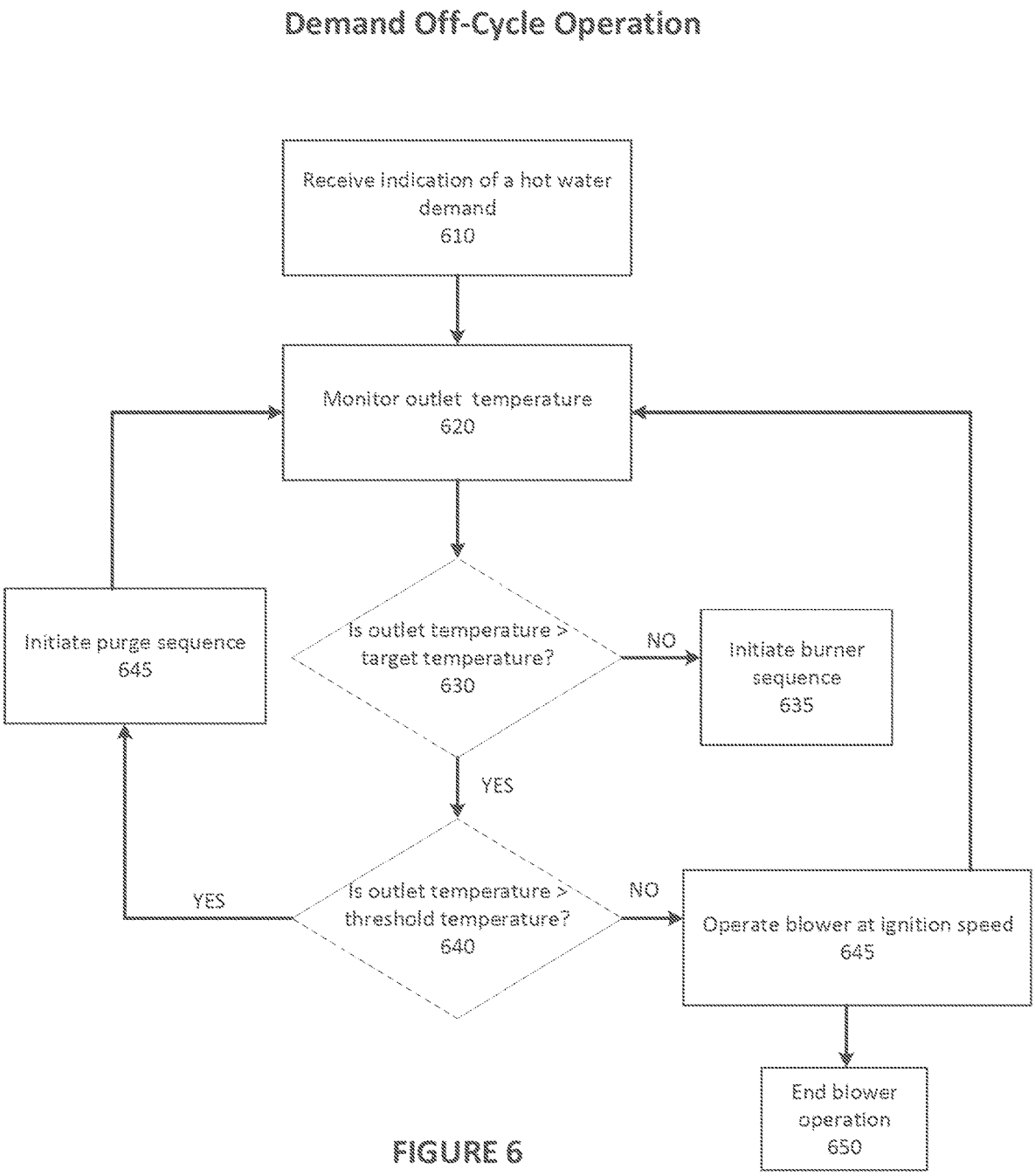
FIG. 6 illustrates a demand off-cycle operation, in accordance with embodiments.

In embodiments, the hot water demand startup algorithm is a control function designed to minimize the amount of response time on instantaneous hot water demands, applicable to both direct-fired water heaters and combi boiler appliances. As illustrated in FIG. 6, upon receiving a flow demand, e.g., a hot water demand 610, the heating system and/or appliance will pre-emptively begin its startup sequence based on a predicted heat loss of stored energy in the appliance. In this manner, energy can be added as soon as possible once the DHW Outlet temperature drops below its target value.

As shown in FIG. 6, an outlet temperature can be monitored 620 following an indication for a hot water demand, including anticipatory demand. As the hot water demand is fulfilled, embodiments analyze hot water temperature compared to the target temperature 630. When the outlet temperature is determined not to be greater than the target temperature, a burner sequence can be initiated 635. When the outlet temperature is greater than the target temperature, a second determination is made regarding whether the hot water outlet temperature is greater than a threshold temperature 640. If yes, a purge sequence 645 is initiated, and the system returns to monitoring the outlet temperature 620. If not, the blower can be operated at the ignition speed 645. The system can then return to monitoring outlet temperature 620, and in some instances, the blower operation can end 650. For example, when the blower is initiated 645, it can be set to run for a certain amount of time, or until a certain condition is reached. In an example, the be blower can be kept running for a certain duration of time, in case the water temperature drops. A drop in water temperature, or other condition, could trigger an initiation of the burner sequence 635 during that time. In examples, the sequence could further comprise checking safety components, starting the blower operation, achieving a threshold blower speed, maintaining blower speed for a "pre-purge" duration, then energizing the gas valve and igniter. In this manner, the gas valve and igniter can be immediately energized when water temperatures drop.

This operation can be applicable for any sequence where the burner or other energy supply method is transitioning from the off- to the on-state, but is defined specifically here for a combustion burner heat source appliance that relies on a blower to control the burner input rate.

In an example, upon receiving a hot water flow demand, the heating system will begin initiating a healing demand sequence. On combi boiler appliances, for example, the internal circulator can start an operation to start transferring any stored energy in the primary heat exchanger to the DHW flow. When the heat exchanger temperature is low enough that energy cannot be extracted into the DHW flow, the appliance will automatically begin its startup sequence, including purging for the required time. When there is additional energy stored in the appliance, the startup sequence will start purging once the DHW Outlet temperature reaches a temperature threshold above the target temperature. This startup threshold will be chosen based on expected appliance use; appliances with higher expected flow demands may use a larger threshold while appliances with lower expected flow demands may have a smaller threshold value set in the control.

Once the purge time has expired, the appliance will then compare the current DHW Outlet temperature to the target value. If the target temperature has been reached, the appliance will proceed to start applying heat to the DHW Outlet temperature, following a prescribed modulation algorithm. If the DHW Outlet temperature is still above the target value, the blower will continue to run at the ignition speed while the control continuously monitors the DHW Outlet temperature, where once the temperature target has been reached, the control will transition the appliance into supplying heat to the DHW demand.

In situations where the boiler shuts down due to a condition where the flow demand still exists but the heat source must be shut off, such as when the DHW Outlet temperature has reached a maximum-allowable value, the appliance will re-enter a purge state that holds the burner off for the same period of time as the startup sequence. At the end of this state, the boiler will again perform the temperature check, and either re-enter a heating sequence if the DHW target has been reached, or continue to hold the blower at the ignition speed 645 until the DHW target has been reached. In embodiments, the blower can be operated at ignition speed 645 until a certain amount of time or other condition has passed.

Combi Boiler Modulation Algorithm

Embodiments of the present invention utilize a control algorithm tied specifically to a combi boiler operation and can utilize a variety of flow sensing and temperature measuring devices to determine a flow demand and a modulation target. While combi boilers are referenced throughout, it will be appreciated that the systems and methods discussed herein can also be applied to other means of instantaneous hot water production such as direct-fired water heaters and the like.

The modulation algorithm and related embodiments match an appliance's supplied power to an expected demand, as accurately as possible to limit an amount of overshoot and prevent appliance cycling, while optimizing the appliance response time to varying Domestic Hot Water (DHW) demands. The expected demand can be determined from measured inputs, as discussed herein.

Various embodiments utilize a combination of flow measurement and temperature measurement to accurately determine a starting modulation to match the demand load, and apply a trimming function based on inaccuracies in the system. In addition, on flow changes where a proactive modulation step must be made, the boiler system determines a new modulation rate based on the flow change.

Accordingly, an optimized time-to-target on both startup and flow change conditions can be realized, while minimizing risk of a DHW outlet temperature overshoot (which, e.g., can lead to a burner shutoff) or an undershoot (which, e.g., can lead to cooler delivery temps while boiler recovers).

Figure 7:
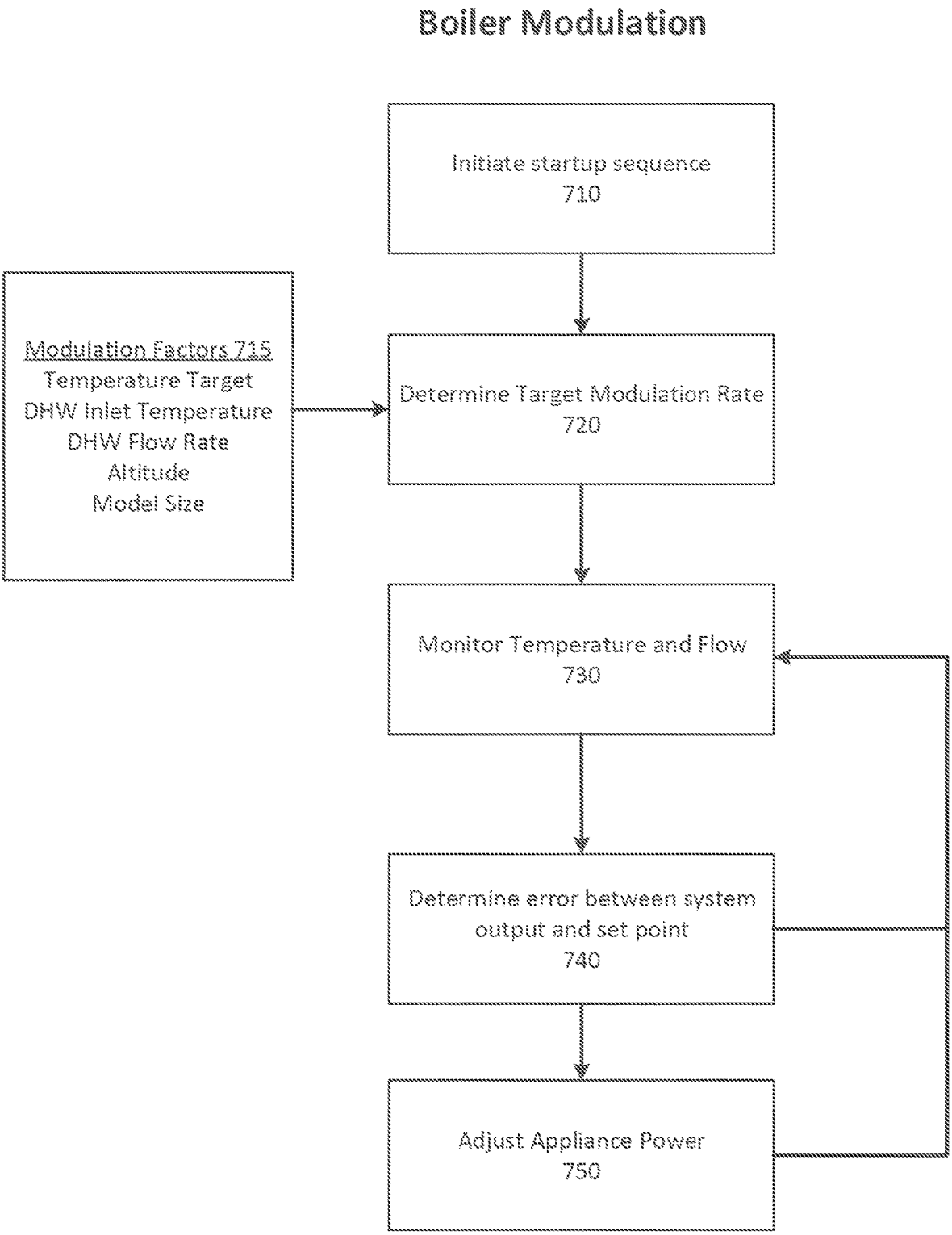
FIG. 7 illustrates a boiler modulation operation, in accordance with embodiments.

As illustrated in FIG. 7, embodiments of the present invention can use a combination of a measured DHW Outlet temperature, DHW Inlet temperature, and DHW Flow Rate to accurately determine an expected target modulation rate. Once the appliance has progressed through its startup sequence 710 and is released to freely modulate, the appliance will determine a target modulation rate 720. The target modulation rate can incorporate a plurality of modulation factors 715, including but not limited to a temperature target, a DHW inlet temperature, a DHW flow rate, altitude, and a model size, e.g., BTU rating, of the unit In embodiments, an initial target modulation rate can be defined as:

$$\text{Initial Target Mod Rate} = \frac{0.5 f_D (T_{DS} - T_{DI})}{\text{Model Size}} \times \left(1 - 0.034 \frac{\text{Altitude}}{1000}\right) \quad (1)$$

where the values are defined as $f_D$=DHW Flow Rate [gpm]

$T_{DS}$=Domestic Hot Water Temperature Target [° F.]

$T_{DO}$=Domestic Hot Water Outlet Temperature [° F.]

$T_{DI}$=Domestic Hot Water Inlet Temperature [° F.]

Model Size=Nominal Appliance BTU Input Size [MBH, 1,000 BTU/hr]

Altitude=Appliance Altitude [ft]

This calculated value is then fed into a PI feedback loop, where the modulation rate can be set no lower than the Initial Target Mod Rate, but am potentially be larger if the initial temperature error (defined as $P_0=T_{DS}-T_{DO}$) is larger than the calculated Initial Target Mod Rate. Embodiments monitor temperature and/or flow rate 730, e.g., for use in the feedback loop. The control system, e.g., controller, can modulate using a PI feedback loop, using the changing temperature error to drive the appliance to its target temperature. Embodiments of the present invention can utilize a PI controller for modulation and control of the PI feedback loop, and calculation of an error amount 740 using the difference between the output of a system and a set point, and adjust the appliance power 750, which can alter the flow rate, accordingly. Temperature errors fed into the feedback loop can thereby adjust the modulation rate if errors exist. Thus, if errors are large, current modulation rates can be adjusted accordingly. In embodiments, adjusting appliance power 750 includes updating the boiler's firing rate, i.e., energy input, to achieve a desired temperature.

While the appliance is running on its PI feedback loop, after the initial modulation rate is calculated, it will continue to monitor the DHW Flow Rate. If the DHW flow demand varies by a significant margin, enough that can be treated as a fixture in the system opening or closing, the appliance will respond by changing its Target Mod Rate by the proportional amount of that flow change.

$$\frac{\text{Target Mode } Rate_{new}}{\text{Target Mod } Rate_{current}} = \frac{f_{D,current}}{f_{D,old}} \quad (2)$$

The modulation rate can be adjusted based on a step change in the flow, and thereby reset the temperature feedback loop for one iteration in the sequence e.g., proportionally, based on that flow change.

Figure 8:
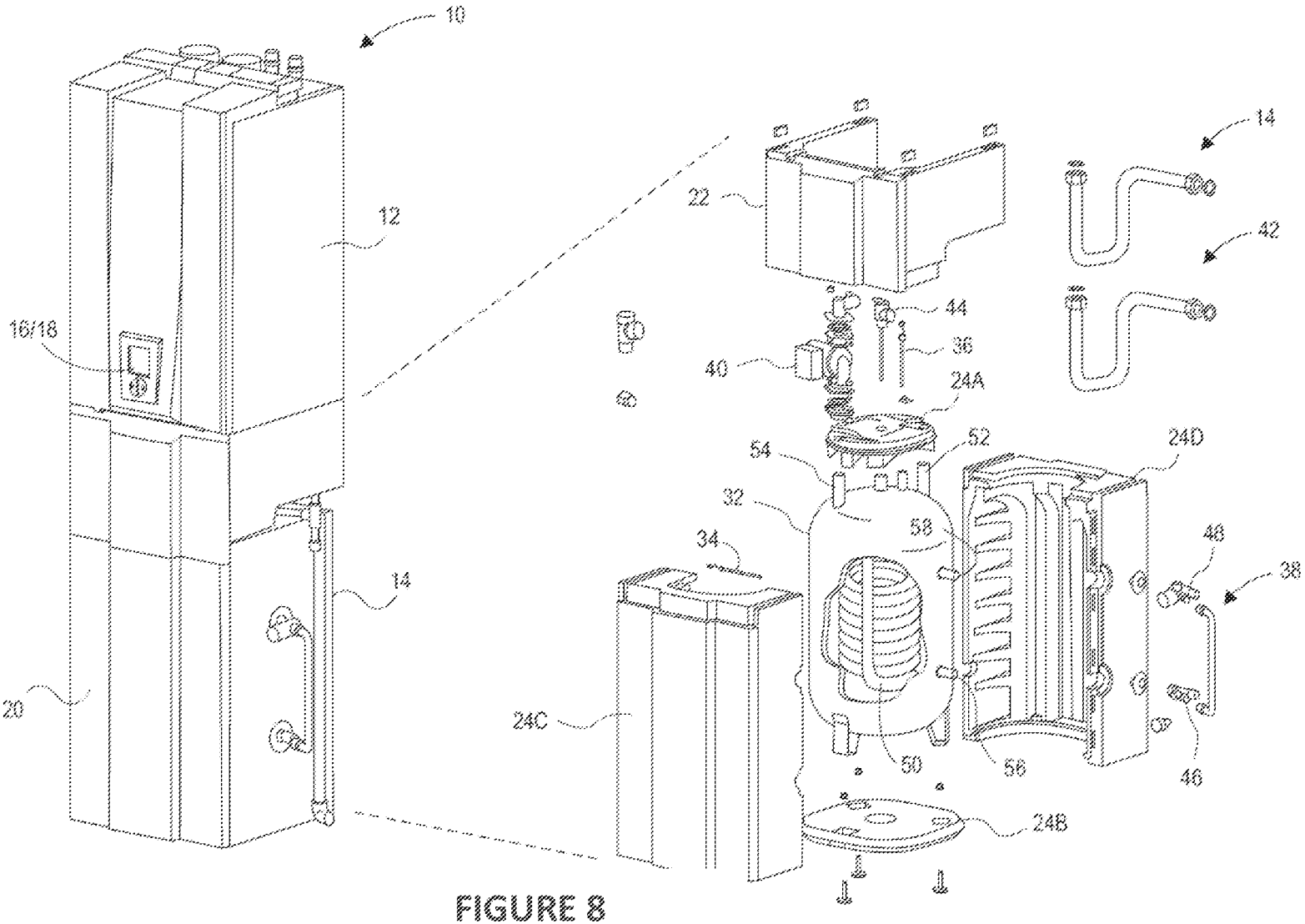
FIG. 8 is a partial cross sectional and exploded view of a hot water heater system suitable for use with an embodiment of the present invention.

FIG. 8 illustrates a partial cross sectional and exploded view of a hot water heater appliance 10 suitable for use with various embodiments of the present invention. As shown in FIG. 8, the hot water heater appliance 10 can include a boiler 12, a companion water heater 14, and a user interface/controller 16/18. In general, the boiler 12 is configured to provide the energy to heat the DHW. The companion water heater 14 is configured to receive the energy from the boiler 12 to heat the DHW. The user interface 16 is configured to provide for two-way communication between a user and the controller 18. In this regard, the user interface 16 includes a display and keys or other such output and input devices. In a particular example, the display includes various menus to select and control modes of operation for the boiler 12 and/or the hot water heater appliance 10. It is a particular advantage of some embodiments that the user interface/controller 16/18 automatically senses installation of the companion water heater 14 and then automatically provide an additional menu for the companion water heater 14. The controller 18 is configured to control the hot water heater appliance 10.

The boiler 12 includes any suitable boiler or device capable of generating delivering energy to tire hot water heater appliance 10. More particularly, the boiler 12 is configured to provide heated water suitable to be transported to the location of energy need. Examples of suitable boilers include: gas fired; oil fired; electric; solar; geothermal; or the like. In a particular example, the boiler is a gas fired boiler configured to heat a supply of water that is then circulated between the boiler 12 and the companion water heater 14.

As shown in the exploded portion of FIG. 8, the companion water heater 14 includes an insulated jacket 20, hot water storage tank 32, sensors 34 and 36, mixing valve assembly 38, circulator pump 40, boiler connectors 42, temperature and pressure relief valve (T&P relief valve) 44, domestic cold water (DCW) in connector 46, and domestic hot water (DHW) out connector 48. The insulated jacket 20 includes any suitable insulating material. In addition, the insulated jacket 20 includes any suitable protective and/or aesthetically pleasing outer materials. Examples of suitable materials for the insulated jacket 20, include foams, polymers, metals, and the like. In a particular example, the insulated jacket 20 includes expanded polypropylene (EPP). The EPP insulated jacket 20 is configured to provide a structural jacket that may absorb kinetic impacts resiliently while also providing thermal insulation. In some embodiments, the insulated jacket 20 may be made exclusively of EPP and it is an advantage of these embodiments that the EPP material may be colored and have an aesthetically pleasing surface as well as providing sufficient structural and insulating properties.

As shown in FIG. 8, the insulated jacket 20 includes a plurality of portions. These portions include structural, insulating, and aesthetic features that greatly improve the hot water heater appliance 10. For example, the insulated jacket 20 may include a bridge 22, top 24A, bottom 24B, front 24C, and back 24D. The bridge 22 or piping access cover may be configured to provide insulation to the piping in the area between the boiler 12 and the companion water heater 14. In addition, the bridge 22 may be configured to aesthetically integrate the boiler 12 and the companion water heater 14. It is an advantage of this aesthetic integration that the hot water heater appliance 10 may be located in a general living area of a domicile rather than closed away in a utility closet. It is another advantage of this aesthetic integration that the working components of the companion water heater 14 are protected. It is yet another advantage of this aesthetic integration and the good surface properties of EPP that the companion water heater 14 may collect less dust than conventional water heaters and boilers and may be easier to clean. Also shown in FIG. 8, the insulated jacket 20 includes a plurality of openings disposed in cooperative alignment with respective inlets and outlets associated with the hot water storage tank 32.

The top 24A, bottom 24B, front 24C, and back 24D are configured to provide the hot water storage tank 32 with insulation to each respective area. For example the top 24A is configured to insulate the top of the hot water storage tank 32 and reduce loss of heat therefrom via radiant loss, thermal conduction, air convection/infiltration and the like. Similarly, the bottom 24B, front 24C, and back 24D are configured to insulate the bottom, front and back (including the sides) of the hot water storage tank 32 and reduce loss of heat therefrom via radiant loss, thermal conduction, air convection/infiltration and the like.

In some embodiments, the portions of the insulated jacket 20 may be removably attached to each other and/or the hot water storage tank 32. For example, the portions of the insulated jacket 20 may include any suitable fastener such snaps, magnets, or the like that are configured to attach to each other and/or to the hot water storage tank 32. In particular examples, the insulated jacket 20 includes a plurality of fasteners 26A configured to align and attach the bridge 22 to the boiler 12. In this manner, the aesthetic integration of the boiler 12 and companion water heater 14 may be further enhanced by the alignment of one to the other. In addition, the insulated jacket 20 may include magnetic fasteners 26B configured to releasably fasten the front 24C to the back 24D. In this manner, the hot water storage tank 32 may be easily accessed for maintenance evaluation and repair (e.g., welding or other such operation). In contrast, conventional hot water tanks are typically covered in spray foam that renders the tank unserviceable. Another negative aspect of conventional spray foam installations is that moisture may be maintained in contact with the tank. The novel EPP 'clamshell' insulated jacket 20 facilitated drawing or wicking moisture from the surface of the hot water storage tank 32.

Optionally, the top 24A and bottom 24B may include lips or other structures configured to releasably lock into slots, grooves or other such structures in the front 24C and back 24D. If included, these structures lock the top 24A and bottom 24B within the front 24C and back 24D when the from 24C and back 24D are fastened and cart be removed when unfastened. In a particular example, the front 24C and back 24D include an annular top slot disposed about an inside portion of the from 24C and back 24D configured to retain the top 24A. In another particular example, the front 24C and back 24D include an annular bottom slot disposed about an inside portion of the front 24C and back 24D configured to retain the bottom 24B. Also optionally, the companion water heater 14 may include leveling feet 28 configured to level and raise or lower the companion water heater 14 in a manner known to those skilled in the art.

The hot water storage tank 32 is configured to receive a supply of domestic cold water and utilize energy in the form of circulating boiler water from the boiler 12 to provide a supply of domestic hot water. The hot water storage tank 32 itself includes a shell of metal or other such material that is sufficiently strong to contain hot water at standard household pressures of 50-70 pounds per square inch (psi) (345-483 kilopascals 'kPa'). The hot water storage tank 32 includes a heal exchange coil 50, exchange inlet 52, exchange outlet 54, DCW inlet 56, and DHW outlet 58.

The sensors 34 and 36 are configured to sense a temperature of the water in the hot water storage tank 32 and forward a signal corresponding to this sensed temperature to the controller 18. The sensors 34 and 36 may include any suitable temperature sensing element such as, for example, a thermocouple, thermistor, or the like. The sensor 34 may be placed in thermal contact with a lower portion of the hot water storage tank 32. In general, the lower portion of the water storage tank 32 represents the lowest temperature in the water storage tank 32 due to the relatively higher density of colder water as compared to warmer water and because the DCW inlet 56 is disposed at the lower portion of the water storage tank 32. The sensor 36 may be placed in thermal contact with an upper portion of the hot water storage tank 32. The upper portion of the water storage tank 32 generally represents to hottest temperatures in the water storage tank 32. As such, the temperature at the upper portion of the water storage tank 32 represents the hottest water that cart be delivered at that particular moment.

The mixing valve assembly 38 includes a thermostatic mixing valve configured to mix outgoing DHW with a controlled amount of incoming DCW to produce DHW at a predetermined maximum DHW temperature. This predetermined maximum DHW temperature may be set by the user or a technician on the mixing valve assembly 38 and/or may be controlled by the controller 18. This allows the hot water storage tank to store a relatively greater amount of thermal energy. In this manner, a relatively higher volume of DHW at the predetermined maximum DHW temperature may be provided for a given volume of the hot water storage tank 32.

The circulator pump 40 is configured to urge water to flow or circulate between the boiler 12 and the heat exchange coil 50. The circulator pump 40 is controlled via the controller 18. Typically, the circulator pump 40 is controlled to start circulating the water or other heating fluid between the boiler 12 and tire heat exchange coil 50 shortly before the boiler 12 begins to supply energy to the boiler water and then continues to circulate for some predetermined time after the boiler 12 stops supplying energy to the boiler water or until a predetermined cool down temperature in the boiler is reached. The circulator pump 40 may, optionally, include a check valve to stop or reduce the flow of water between the boiler 12 and the heat exchange coil 50 while the circulator pump 40 is unpowered. This unpowered flow may draw out heat from the hot water storage tank 32 if left unchecked.

The connectors 42 may include any suitable conduit and/or fittings for conveying boiler water between the boiler 12 and companion water heater 14. In a particular example, the connectors 42 include flexible stainless steel piping suitable for fluidly connecting the boiler 14 to the companion water heater 14.

In general, the heat exchange coil 50 is configured to provide a conduit for water or other heated fluid from the boiler 12 to be conveyed through the hot water storage tank 32 and to exchange the heat therein with the water in the hot water storage tank 32. Of note, the boiler water and DHW are not mixed, but rather, heat from the boiler water is imparted upon the DHW through the material making up the heat exchange coil 50. To efficiently exchange this heat, the heat exchange coil 50 may be made from a conductive material such as metal and may have a relatively long, circuitous path. In addition, the beat exchange coil 50 may optionally include radiating fins or other such implement to increase thermal exchange. In other examples, the heat exchange coil 50 may be art external, jacket-style heat exchange or other such heat exchanger.

Figure 9:
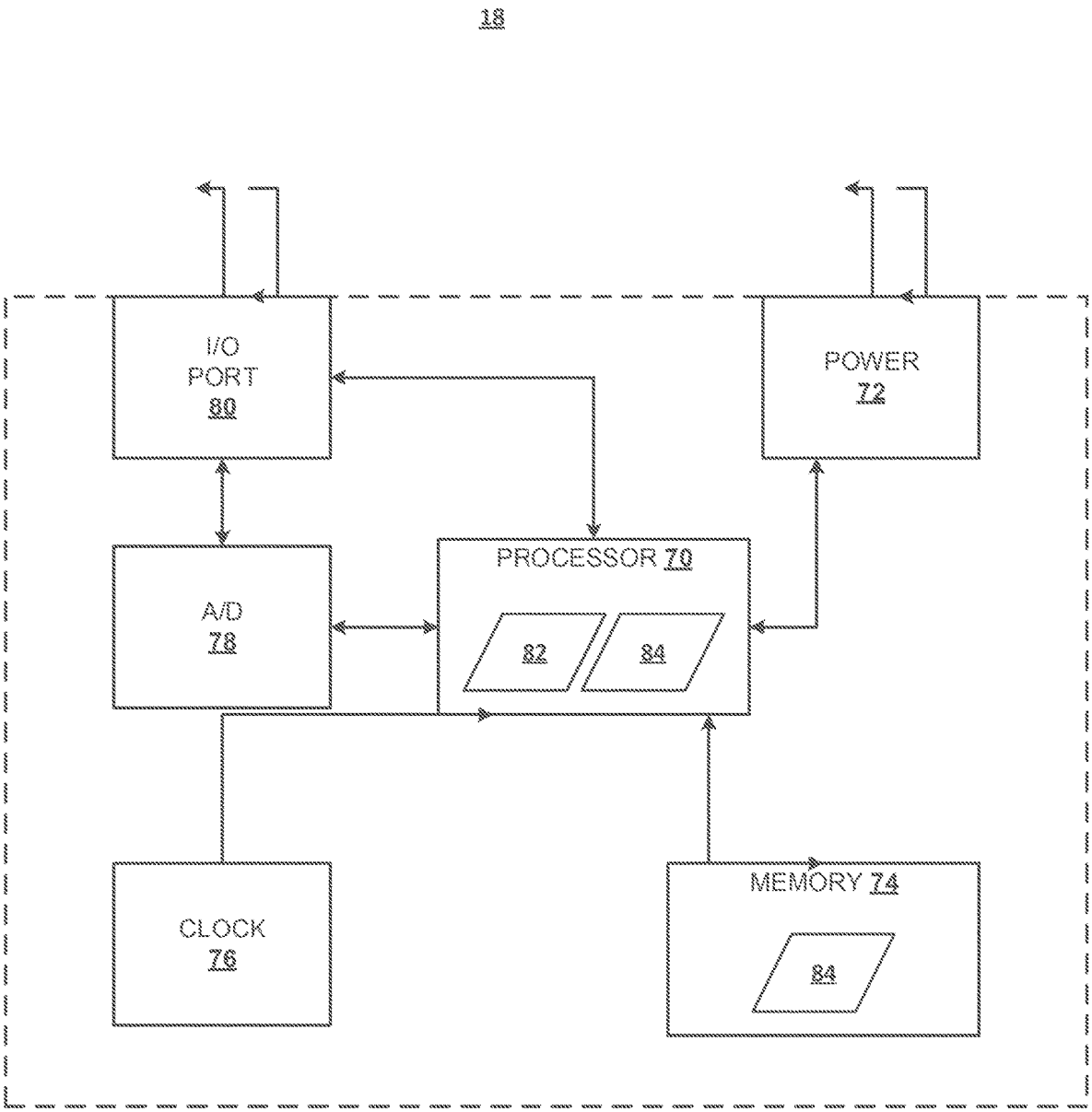
FIG. 9 is a block diagram of a controller for a hot water heat in accordance with embodiments of the present invention.

FIG. 9 is block diagram of the controller 18 for the hot water beater appliance 10 depicted in FIG. 8. As shown in FIG. 9, the controller 18 includes a processor 70. This processor 70 is operably connected to a power supply 72, memory 74, clock 76, analog to digital converter (A/D) 78, and an input/output (I/O) port 80. The I/O port 80 is configured to receive signals from any suitably attached electronic device and forward these signals to tire A/D 78 and/or the processor 70. For example, the I/O port 80 may receive signals associated with temperature measurements from one or more of the sensors 34, 36, and 64 and forward the signals to the processor 70. In another example, the I/O port 80 may receive signals via a user interface 16 and forward the signals to the processor 70. If the signals are in analog format, the signals may proceed via the A/D 78. In this regard, the A/D 78 is configured to receive analog format signals and convert these signals into corresponding digital format signals. Conversely, the A/D 78 is configured to receive digital format signals from the processor 70, convert these signals to analog format, and forward the analog signals to the I/O port 80. In this manner, electronic devices configured to receive analog signals may intercommunicate with the processor 70.

The processor 70 is configured to receive and transmit signals to and from the A/D 78 and/or the I/O port 80. The processor 70 is further configured to receive time signals from the clock 76. In addition, the processor 70 is configured to store and retrieve electronic data to and from the memory 74. Furthermore, the processor 70 is configured to determine signals operable to modulate the boiler 12 and thereby control the amount of heat imparted to the hot water storage lank 32. For example, in response to the processor 70 determining the water in the hot water storage tank 32 is below a predetermined minimum temperature, the processor 70 may forward signals to the various components of the boiler 12 and the circulator pump 40 to provide heat to the heat exchange coil 50 and thereby heat the water in the hot water storage tank 32.

According to an embodiment of the invention, the processor 70 is configured to execute a code 82. In this regard, the controller 18 includes a set of computer readable instructions or code 82. According to the code 82, the controller 18 is configured to modulate an amount of energy imparted into the hot water storage tank 32 by the boiler 12. In addition, the controller 18 may be configured to generate and store data to a file 84. This file 84 includes one or more of the following: sensed temperatures; timestamp information; determined temperature profiles (e.g., rate at which the temperature is rising or falling); user input temperature profiles; recommended temperature profiles; DHW usage trends; heating schedules of various performance modes; and the like.

Based on the set of instructions in the code 82 and signals from one or more of the sensors 34, 36, and 64, the processor 70 is configured to: determine the thermal capacity presently in the hot water storage tank 32; determine the temperature profile of the water in the hot water storage tank 32; determine the outflow of DHW from the hot water storage tank 32 based on the temperature profile; determine DHW usage trends; and determine whether the thermal capacity presently in the hot water storage tank 32 is sufficient for the expected usage based on DHW usage trends or current water temperatures based on signals from the sensors 34 and/or 36. For example, the processor 70 receives the sensed temperature and/or an average sensed temperature, compares this to previous temperatures over time to determine the current temperature profile. The processor 70 compares the current temperature profile to expected thermal loss without DHW usage (e.g., standby loss) to determine if usage is occurring and, if so, how much. In some performance modes, the processor 70 determines whether this amount of usage will exceed the thermal capacity of the hot water storage tank 32 and may fire the boiler 12 proactively to prevent the temperature of the outflow DHW from falling below a predetermined minimum. In other performance modes, the processor 70 may wait until the temperature of the outflow DHW falls below the predetermined minimum before controlling the boiler 12 to fire. In addition, if the processor 70 determines that no DHW draw is occurring, the processor 70 may wait until a draw occurs before controlling the boiler 12 to fire. Optionally, processor 70 may be configured to periodically raise the temperature above a biological killing temperature in order to ensure biological growth does not occur. For example, even if a user selects maximum temperature below the biological killing temperature, the processor 70 may periodically raise the temperature above the maximum temperature and the biological killing temperature in order to ensure biological growth does not occur.

In various examples, knowing the temperature at the bottom and top of the hot water storage tank 32, by virtue of the sensors 34 and 36 respectively, facilitates a greater flexibility and improved efficiency as compared to systems without such capabilities. In a first example, the processor 70 may use information on incoming water temperature (as sensed by the temperature sensor 34, for example) to ad just the temperature profile to use the minimum energy needed to satisfy the DHW demand. In a particular example, in the summer, warmer ground water temperature would require less energy to raise the delivered DHW to the same temperature as in the winter. As such, a lower boiler water deliver temperature may be able to satisfy the same flow rate in the summer as a higher delivery temperature would in the winter. Lower boiler water temperatures allow the boiler 12 to run at a higher efficiency.

In a second example, by knowing the temperature at both the top and bottom of the tank, the processor 70 may change the target boiler water temperature during a DHW draw in order to most effectively meet the demand. The processor 70 may increase the delivery temperature to facilitate transferring maximum energy to the DHW. Also, in response to signals from the sensor 36, the processor 70 may determine that the top of the hot water storage tank 32 has reached its targeted temperature and may change (decrease) the target boiler water temperature in order to limit the energy added to the top of the hot water storage tank 32 while still adding energy to the colder water at the bottom of the hot water storage tank 32. This feature of the processor 70 drastically increases the thermal storage of the hot water storage tank 32 by adding the maximum amount of energy to the hot water storage tank 32 while preventing the honest water in the hot water storage tank 32 from greatly overshooting its target temperature and is a great improvement in the art. This symptom of overshooting a targeted DHW delivery temperature is known to those familiar with the art as thermal stacking. Thermal stacking can, in some circumstances, lead to significantly hotter DHW than desired due to adding excessive energy to the top of the storage tank in order to recover the colder water in the tank to the desired temperature. It is an advantage of embodiments described herein that significantly greater control over this negative performance characteristic is provided as compared to conventional storage water heaters.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A heater system configured to modulate a heating input rate, the heater system comprising:

a heat exchanger configured to heat water and deliver the heated water to a domestic hot water outlet;

a first sensor designed to sense a temperature of the heated water at the domestic hot water outlet;

a second sensor designed to sense a flow rate of the heated water at the domestic hot water outlet; and a control system configured to:

determine an expected flow demand for the heated water based on an expected appliance use;

determine an initial heating input rate based on the expected flow demand;

monitor the sensed temperature and the flow rate;

detect a change in at least one of the sensed temperature and the flow rate;

determine a target heating input rate based on the detected change at least one of the monitored water temperature and the flow rate; and modulate the initial heating input rate to the target heating input rate when the target heating input rate is greater than the initial heating input rate.

2. The heater system of claim 1, wherein the target heating input rate is based on at least one of the sensed flow rate at the domestic hot water outlet, a target hot water delivery temperature, a domestic hot water outlet temperature, a domestic hot water inlet temperature, an energy input rating of the heater system, or an altitude.

3. The heater system of claim 1, wherein the initial heating input rate is modulated proportionally with the detected change in the sensed flow rate at the domestic hot water outlet.

4. The heater system of claim 1, wherein modulating the initial heating input rate is based on a PI feedback loop using the water temperature of the heated water at the domestic hot water outlet.

5. The heater system of claim 1, wherein the heater system is an instantaneous water heater.

6. A heater system configured to modulate a heating input rate, the heater system comprising:

a first heat exchanger configured to heat water;

a second heat exchanger configured to receive the heated water from the first heat exchanger and deliver water to a domestic hot water outlet;

a plurality of temperature sensors for sensing a plurality of water temperatures at one or more locations within the heater system;

a flow detector designed to measure a flow rate at the domestic hot water outlet;

a control system configured to:

determine an expected flow demand for the heated water based on an expected appliance use;

determine an initial heating input rate based on the expected flow demand;

monitor the plurality of water temperatures and the flow rate;

determine a target heating input rate based on at least one of the plurality of sensed water temperatures or the flow rate at the domestic hot water outlet;

modulate the initial heating input rate to the target heating input rate when the target heating input rate is different than the initial heating input rate;

detect a change in at least one of the sensed temperatures or the flow rate; and modulate the target heating input rate proportionally with the detected change.

7. The heater system of claim 6, wherein monitoring the plurality of water temperatures comprises monitoring an inlet water temperature at the second heat exchanger and an outlet water temperature at the second heat exchanger.

8. The heater system of claim 6, wherein monitoring the plurality of water temperatures comprises monitoring an inlet water temperature at the first heat exchanger and an outlet water temperature at the first heat exchanger.

9. The heater system of claim 6, wherein the heater system is a combi boiler.

10. The heater system of claim 6, wherein the target heating input rate is determined based on at least one of the measured flow rate at the domestic hot water outlet, a target hot water delivery temperature, a domestic hot water outlet temperature, a domestic hot water inlet temperature, an energy input rating of the heater system, or an altitude.

11. The heater system of claim 6, wherein modulating the initial heating input rate is based on a PI feedback loop using the sensed water temperature.

12. The heater system of claim 1, wherein the expected appliance use is based on a supplied power to an appliance.

13. The heater system of claim 1, wherein the control system is further configured to:

determine whether the sensed temperature of the heated water at the domestic hot water outlet is greater than a target domestic hot water outlet temperature;

determine whether the sensed temperature of the heated water at the domestic hot water outlet is greater than a threshold domestic hot water outlet temperature; and initiate a purge sequence when the temperature of the heated water at the domestic hot water outlet is greater than both the target domestic hot water outlet temperature and the threshold domestic hot water outlet temperature.

14. The heater system of claim 1, wherein the control system is further configured:

determine a difference between the initial heating input rate and the target heating input rate; and modulate the initial heating input rate to the target heating input rate when the determined difference is greater than a threshold margin.

15. A heater system configured to modulate a heating input rate, the heater system comprising:

a heat exchanger designed to heat water and deliver the heated water to a domestic hot water outlet;

a flow sensor designed to measure a flow rate of the heated water at the domestic hot water outlet; and a control system designed to:

determine an expected flow demand for the heated water based on an expected appliance use;

determine an initial heating input rate based on the expected flow demand;

monitor the measured flow rate;

detect a change in the measured flow rate;

determine a target heating input rate based on the detected change in the measured flow rate; and modulate the initial heating input rate to the target heating input rate when the target heating input rate is greater than the initial heating input rate.

16. The heater system of claim 15, wherein the target heating input rate is further based on one or more modulation factors including a temperature of the heated water at the domestic hot water outlet, a temperature of water at an inlet of the heater system, an altitude value for the heater system, and a model size of the heater system.

17. The heater system of claim 15, wherein the expected appliance use is determined by an amount of power supplied to one or more appliances.

18. The heater system of claim 15, further including a temperature sensor designed to measure a temperature of the heated water at the domestic hot water outlet.

19. The heater system of claim 18, wherein the target heating input rate includes a target temperature of the heated water at the domestic hot water outlet.

20. The heater system of claim 19, wherein the control system is further designed to:

determine an error amount between the measured temperature and the target temperature of the heated water at the domestic hot water outlet; and adjust the target heating input rate based on the error amount.

* * * * *